United States Patent [19]

Seragnoli

[11] 4,134,502

[45] Jan. 16, 1979

[54] APPARATUS FOR FORMING GROUPS MADE UP BY A PLURALITY OF SIDE-BY-SIDE POSITIONED PILES OF PARALLELEPIPEDON SHAPED ARTICLES

[75] Inventor: Enzo Seragnoli, Bologna, Italy

[73] Assignee: G.D. Societa per Azioni, Bologna, Italy

[21] Appl. No.: 780,099

[22] Filed: Mar. 22, 1977

[51] Int. Cl.[2] ..... B65G 57/30

[52] U.S. Cl. ..... 214/6 BA; 53/54

[58] Field of Search ..... 214/6 BA; 53/54, 159

[56] References Cited

U.S. PATENT DOCUMENTS

| | | | |
|---|---|---|---|
| 2,008,870 | 7/1935 | Little | 53/54 |
| 2,029,933 | 2/1936 | Milmoe | 53/54 |
| 3,040,862 | 6/1962 | Schmermund et al. | 214/6 BA |
| 3,220,570 | 11/1965 | Swanson et al. | 214/6 BA |
| 3,553,929 | 1/1971 | Revicki | 214/6 BA |
| 3,570,209 | 3/1971 | Solwasser | 214/6 BA |

*Primary Examiner*—Albert J. Makay
*Assistant Examiner*—Ross Weaver
*Attorney, Agent, or Firm*—Karl F. Ross

[57] ABSTRACT

The apparatus comprises a pair of pushers synchronously moved at a frequency equal to 1/n of the frequency of pile forming means. The first pusher feeds individual piles into a rejecting and replenishment device, and the second pusher removes individual piles from the same rejecting and replenishment device, and feeds them to an exiting channel wherein individual groups of piles are formed and delivered to the parcelling or cartoning machine.

5 Claims, 2 Drawing Figures

APPARATUS FOR FORMING GROUPS MADE UP BY A PLURALITY OF SIDE-BY-SIDE POSITIONED PILES OF PARALLELEPIPEDON SHAPED ARTICLES

BACKGROUND OF THE INVENTION

The present invention relates to an apparatus for forming groups of side-by-side piles of parallelepipedon shaped articles. In particular, the present invention relates to an apparatus for gathering into parallelepipedon shaped groups a plurality of cigarette packets, delivered by an high-speed cellophane wrapping machine, which groups are to be supplied to a parcelling or cartoning machine.

The groups of packets can be conceived as obtained by superposing two or more rows, formed by the same number of packets, or even by bringing a plurality of piles, each consisting of the same number of packets, close together.

DESCRIPTION OF THE PRIOR ART

The conventional cigarette production plants, as known, consist of two different type of machines, i.e.:

(1) Manufacturing machines, by which cigarettes are made starting from the cut and cured tobacco leaves; and (2) Cigarette conditioning machines.

The latter machines usually comprise:

(a) the packeting machines, for making cigarette packets;

(b) the parcelling or cartoning machines, for making packages or cartons containing a plurality of cigarette packets;

(c) the cellophane wrapping machines, for wrapping with cellophane, or other similar material, individual cigarette packets;

(d) the overwrapping machines for overwrapping packages or cartons.

In cigarette plants, the cellophane wrapping machines are positioned between the packeting machines and the parcelling or cartoning machines, while the overwrapping machines are positioned downstream of the parcelling or cartoning machines.

The operating output speed of the packeting machines can range between 100/200 cigarette packets up to 400 cigarette packets per minute.

The operating output speed of the parcelling or cartoning machines is a function of the number of cigarette packets making up the individual packages or carton.

The present invention aims to solve the problems concerned with the feeding of the parcelling or cartoning machines by the cellophane wrapping machines.

SUMMARY OF THE INVENTION

The main object of the present invention is, therefore, to provide an apparatus for connecting a cellophane wrapping machine operating at very high output speed (400 packets per minute) to a parcelling or cartoning machine, without any loss of operating cycles.

Another object of the present invention is to provide such an apparatus by which piles, consisting of any desired number of packets, can be formed.

A further object is to provide, in conformity with the above objects, an apparatus able to feed individual piles of cigarette packets to a rejection and replenishment device, for rejecting defective piles and for replenishing said defective piles with non-defective piles, and — in the meantime — able to reject individual piles from the same device in such a manner to build up complete groups of packets made up by any desired number of piles.

These and other objects are all attained, according to the present invention, by an apparatus comprising a vertically and reciprocatingly movable pile forming means positioned upstream of a rejecting and replenishment device for forming piles of a preselected number n of packets; first and second means synchronously and reciprocatingly moving with a frequency equal to 1/n that of said pile forming means, said first means for feeding individual piles into said rejecting and replenishment device, and said second means for sequentially removing piles from said rejecting and replenishment device, and for feeding successive piles along an exiting channel, from which individual complete groups made up by a plurality of side-by-side positioned piles are conventionally fed to a parcelling or cartoning machine.

BRIEF DESCRIPTION OF THE DRAWINGS

A preferred embodiment of the invention is thereinafter described with reference to the accompanying drawing. In the drawings.

DESCRIPTION OF THE PREFERRED EMBODIMENT

Figure 1:
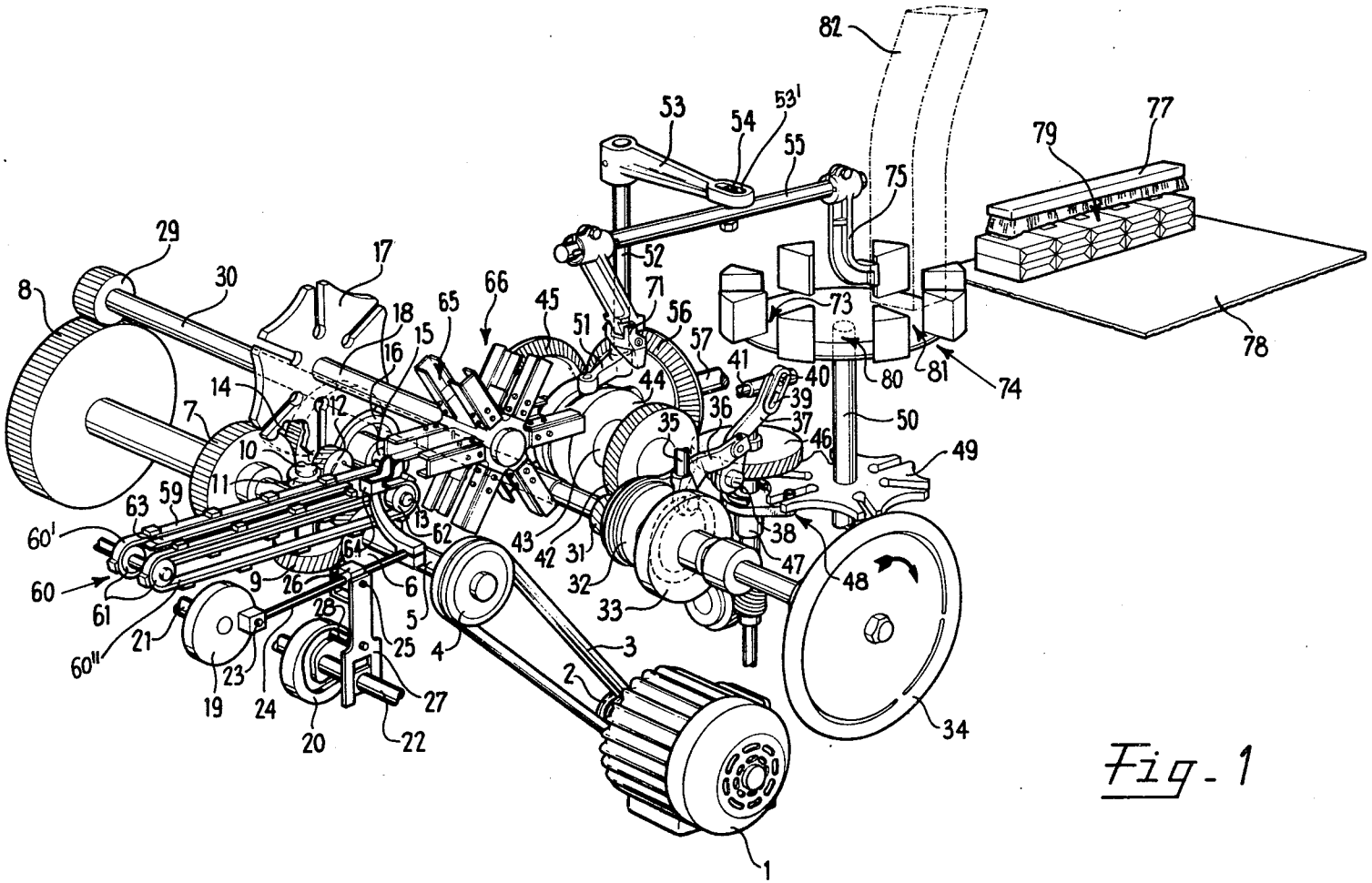
FIG. 1 is a perspective view of the mechanism for driving the apparatus according to the invention.

For a clear understanding of the present invention, only the essential components of a high-speed operating cellophane wrapping machine are shown in the drawing, the machine being well known to the ordinary worker in this art.

With particular reference to FIG. 1, an electric motor 1 drives a cellophane wrapping machine, of the type -for example- manufactured by the present applicant as herein, and known on the trade as "4350/CELL," conceived to wrap up to 400 cigarette packets per minute.

Keyed on a horizontal shaft of said motor 1 is a pulley 2, by which a second pulley 4, keyed on one end of a horizontal main shaft 5, is driven by a belt transmission 3. On the same shaft 5 are keyed, starting from said one end, a skew gear wheel 6, a gear 7, and a gear wheel 8.

The skew gear wheel 6 meshes with a gear 9, keyed on the lower end of a vertical shaft 10, by which in turn, a shaft 13, parallel to shaft 5, is driven through a pair of skew gear wheels 11 and 12. The task of the shaft 13 will be described hereinafter.

A shaft 15, extending parallel to shaft 5, is driven by the gear 7, though a gear 14, and carries a conventional device 16, by which a six-space Maltese cross 17 is intermittently driven. The Maltese is cross keyed on the left end (viewing FIG. 1) of a shaft 18, also extending parallel to the main shaft 5.

The device 16 conventionally comprises oppositely positioned pins, or idle rollers, and a centering member in the form of an arcuate sector. The latter components have not been shown for the sake of clarity, in the drawing.

With 19 is indicated an eccentric keyed on a shaft 21, and with 20 is indicated a grooved cam keyed on a shaft 22, both of these latter shafts extending parallel to the main shaft 5, and driven in a conventional manner, not shown.

A rod 24, extending perpendicularly to the main shaft 5, has one end pivotally connected, in 23, to the eccentric 19, and the other end of said rod 24 carries a pusher 64. On the rod 24 is slidingly mounted a block 26 having horizontal pins 25 engaging the upper end of a link rod 27. The lower end of the link rod 27 is provided with an idle cam follower 28 engaging the groove of cam 20.

With such a construction, an axially directed, reciprocating motion is imparted by the eccentric 19 to the rod 24, and a swinging motion in a vertical plane extending through the axis of same rod 24, is superimposed on this axially directed, reciprocating motion by the action of cam 20.

A shaft 30, extending parallel to the main shaft 5, is driven by the gear 8, through a gear 29 keyed to shaft 30, the latter from left to right (viewed in FIG. 1), carries a gear 31, an eccentric 32, a grooved cam 33, and — at the right end — a handwheel 34 for manually adjusting the apparatus.

Slidingly engaged with the groove of cam 33 is a cam follower, shown with dashed lines in FIG. 1, secured to the lower end of a vertical rod 35 to which an axially directed reciprocating motion is imparted along stationary guides (not shown) when the shaft 30 rotates. The upper end of rod 35 carries (FIG. 2) a pile-forming means 68, the task of which will be explained hereinafter.

The eccentric 32 rotates freely within a ring provided on one end of a link rod 36, the opposite end of said link rod 36 hinged to a lever 37 pivotally fitted, by a pin 38, on the bed (not shown) of the cellophane wrapping machine, and which lever 37 has its free end formed with a slot 39.

Figure 2:
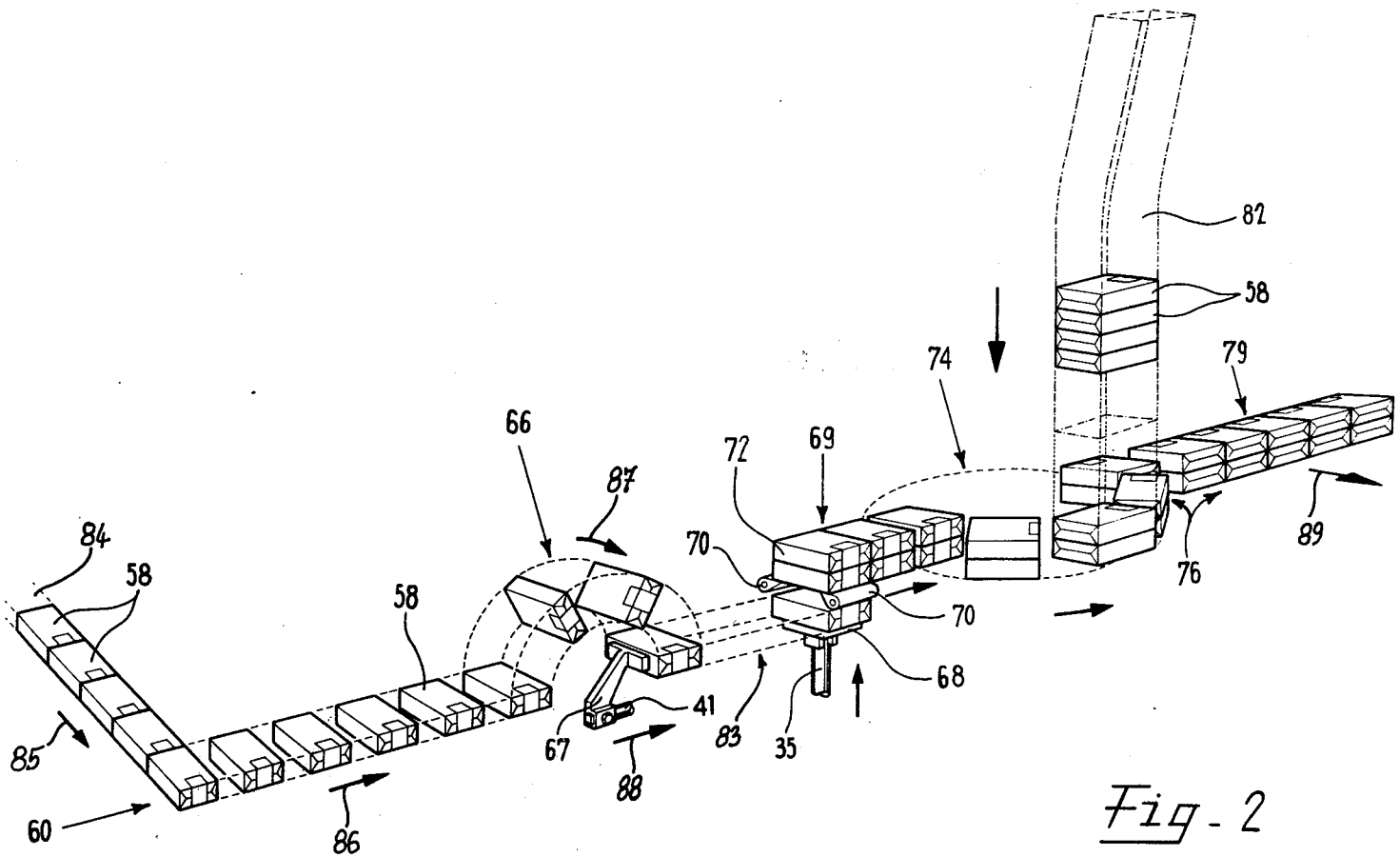
FIG. 2 is a diagrammatic schematic view showing the sequence of the various operations, performed by means driven by the mechanism according to FIG. 1, to build up complete groups from continuously fed cigarette packets.

Slidingly fitted in said slot 39, by means of a sliding shoe (not shown), is a horizontal pin 40, by which the lever 37 is connected to one end of a horizontal rod 41, perpendicularly extending relative to the main shaft 5, and to which a reciprocating axial motion, along stationary guides (not shown), is imparted through the above described connection. As shown in FIG. 2, a pusher 67 is secured on the other end of rod 41.

The gear 31 meshes with a gear 42 keyed on a shaft 43, extending parallel to the main shaft 5, and whereon a drum-shaped cam 44 and a bevel gear 45 are also keyed on.

The drive is transmitted from the gear 42, through a gear 46, to a vertical shaft 47. Secured to said shaft 47 is a conventional device 48, comprising a pin and an arcuate sector (not shown), by which a six-space Maltese cross 49, keyed on the lower end of a vertical shaft 50, is intermittently driven. On the upper end of shaft 50 is secured a horizontal compartmented wheel 74, having a plurality of radially disposed compartments 73.

Slidingly engaged with the groove of the drum-shaped cam 44 is a cam follower secured to one end of a lever 51, the other end of said lever being secured to the lower end of a vertical shaft 52.

The upper end of shaft 52 carries a horizontal arm 53, the free end of which is provided with a slot 53' engaging, through a sliding shoe (not shown), a pin 54 vertically protruding from the middle portion of a horizontal rod 55. The rod 55 is free to axially slide along guides, not shown but secured to the bed of the cellophane wrapping machine.

One end of the rod 55 carries a first pusher 71, and the other end of the same rod carries a second pusher 75, both pushers substantially lying on the same horizontal plane containing the upper surface of the horizontal compartmented wheel 74.

The revolving motion of the drum-shaped cam 44 results, through the connection above described, in a swinging motion in a horizontal plane of arm 53, and in axially directed, reciprocating motion of rod 55 in unison with pushers 71 and 75.

The bevel gear 45 meshes with a bevel gear 56 keyed on one end of a horizontal shaft 57, perpendicularly extending relative to the main shaft 5. Said shaft 57 represents the source of drive of the parcelling or cartoning machine, located downstream of the cellophane wrapping machine, and fed with groups of cigarette packets made up by the apparatus according to the present invention.

With 60 is generically indicated a first horizontal inlet channel, conventionally comprising a pair of spaced apart endless conveying belts 60' and 60" wound about idle rollers 61, and about rollers 62 (only one is shown in FIG. 1) keyed on the shaft 13.

The two belts 60' and 60" are spaced apart of a distance sligthly shorter than the length of a cigarette packet 58, so that to support each packet on the two opposite ends thereof. Between the two belts 60' and 60" is longitudinally positioned, coplanar with the upper run of the same belts, a strip 63.

The channel 60 is formed by a plurality of compartments 59, each for housing a packet 58, and is provided for individually and sequentially feeding cigarette packets 58 into radially disposed packets 65 (six in the embodiment shown) of an intermittently, clockwise rotating wrapping wheel 66 constituting part of the cellophane wrapping machine and keyed on the horizontal shaft 18.

The pusher 67 moves along a second outlet channel, shown with broken lines in FIG. 2 and generically indicated with 83. Said second channel 83 lies on the same horizontal plane containing the first inlet channel 60, but opposite to the wrapping wheel 66, and extends up to the pile forming means 68.

The first pusher 71 moves along a third channel, generically indicated in FIG. 2 with 69, the inlet portion of which channel 69 overlaps the pile forming means 68, is spaced above the second channel 83 by a distance substantially corresponding to the thickness of a packet 58, and extends up to the horizontal compartmented wheel 74. The length of said third channel 69 is, in the embodiment shown, twice the crosswise dimension of the packets 58.

On each side of the inlet portion of the third channel 69, i.e. on that portion overlapping the pile forming means 68, there is provided a resiliently movable retaining means 70 (FIG. 2) which can be moved from a first substantially horizontal operative position to a second substantially vertical inoperative position. Spring means, not shown, reacts to return said retaining means to the first operative position any time they are moved off.

The second pusher 75 moves along a fourth channel, generically indicated in FIG. 2 with 76, connecting the compartmented horizontal wheel 74 with a supporting surface 78.

As particularly shown in FIG. 2, the cigarette packets, delivered by a packeting machine (not shown, and advantageously of the type described in the U.S. Pat.

Nos. 3,628,309 and 3,948,115 and U.S. application Ser. No. 423,178 filed Dec. 10, 1973 now abandoned and commonly assigned herewith), are fed to the cellophane wrapping machine by a continuously driven conveyor 84, parallel to the main shaft 5, in the direction of arrow 85. On said conveyor 84 the packets 58 are end-to-end and flatwise positioned.

As disclosed in the U.S. application Ser. No. 432,587 filed Jan. 10, 1974 now abandoned, in the name of the same Applicant as herein, at the discharge end of the conveyor 84, the packets 58 are individually housed into the compartments 59 (FIG. 1) of the conveyor, or first inlet channel 60. As shown in FIG. 2, the conveyor 60 is transversely positioned relative to conveyor 84, and is continuously moved in the direction of arrow 86.

In the operation, a packet 58 is continuously moved by the conveyor 60 until it reaches the right end of the same conveyor, wherein the pusher 64, secured to the free end of rod 24, is standing.

The eccentric 19, cam 20 and link rod 27 cooperate, as above stated, to impart an axially directed, reciprocating motion to the rod 24 to extend the pusher 64, during its forward stroke, in between the belts 60' and 60'', just downstream of that compartment 59 which reached the right end of conveyor 60, so as to push the packet 58 housed in said compartment — together with a piece of cellophane wrapping material, not shown and fed in any conventional manner — into that one of the radial pockets 65 which is dwelling in an inlet station aligned with the conveyor 60.

After insertion of a packet into a pocket 65, the pusher 64 begins its backward stroke, by swinging downwardly to prevent it from interferring with the next packet 58 advancing on the conveyor 60, and with which it will come into engagement during its next forward stroke.

The considered cigarette packet 58, due to the stepwise and clockwise rotation (arrow 87, FIG. 2) of the wrapping wheel 66, is transferred from said inlet station to a diametrally opposite outlet station, and during said transferring the considered packet 58 is subjected to a first series of wrapping operations by conventional (not shown) stationary and movable folding means, as well as by welding means fitted about the wrapping wheel 66.

On the outlet station operates the pusher 67, which removes the considered and partially wrapped packet from the relative pocket 65, and moves it onto the second channel 83, along which the wrapping operations are completed.

The second channel 83 has a length equal to a multiple of the crosswise dimension of the packets 58, and — during normal operation — said second channel accomodates a row made up by a certain number of side-by-side positioned packets. The insertion of a new packet into channel 83 causes, thefore, the row of packets to move, in the direction of arrow 88, of a distance corresponding to the crosswise dimension of a packet, and the transfer of the first packet of the row onto the pile forming means 68, now dwelling in a donwardly directed inoperative position.

During the upward stroke of the pile forming means 68, controlled by the cam 33 through the vertical rod 35, the packet previously transferred onto said means 68, is pushed through the spring controlled retaining means 70, and -during the return stroke of means 68- retained by said means 70 in the inlet portion of the third channel 69.

As above stated, the first and second pushers 71 and 75 are secured to the two ends of the rod 55, and they are actuated in unison by said rod 55 with a frequency which is half that of the pile forming means 68.

Since the first pusher 71, carried by the left end (viewing FIG. 1) of rod 55, is horizontally reciprocated along the third channel 69, in the time interval between two successive interventions of said pusher 71, a pile 72 — consisting of two superposed packets 58 — is formed by the pile forming means 68 in the inlet portion of the third channel 69, the newly formed pile being in a side-by-side relationship with the previously formed pile, the latter now resting on the outlet portion of the same channel 69.

In its forward stroke, the pusher 71 engages the left side of the pile 72 resting on the inlet portion of the channel 69, and pushes it up to the outlet portion of the same channel, thus allowing the formation, by the pile forming means 68, of a new pile 72 in the inlet portion of said channel 69.

As a consequence of the shifting of a pile 72 from the inlet portion of channel 69 up to the outlet portion of the same channel, the pile previously positioned in said outlet portion is pushed into that one of the compartments 73 of the whell 74, dwelling in an inlet station aligned with the channel 69, and -therefore- aligned with the path of pushers 71 and 75.

The horizontal compartmented wheel 74, as above stated, is keyed on the upper end of shaft 50, and it is intermittently, anticlockwise rotated at the same frequency of the pushers 71 and 75, so that at each forward stroke of the pusher 71, successive piles 72 are inserted into successive compartments 73 of wheel 74.

Due to the intermittent rotation of the horizontal compartmented wheel 74, the piles 72 housed in the compartments 73 are transferred from the inlet station to an oppositely disposed outlet station in alignment with the fourth channel 76, and during each forward stroke of the second pusher 75, working in unison with the first pusher 71, a pile will be removed from said outlet station, and pushed onto said fourth channel 76.

At each stroke from left to right of rod 55, a pile is introduced into a compartment 73 by the first pusher 71, and a pile is removed from the diametrally opposite compartment 73 by the second pusher 75, and by said later pusher introduced into the fourth channel 76, thus gradually forming — on the supporting surface 78 — a complete group 79 underneath a conventional brush 77 (in the example shown, the complete group 79 is made up by five side-by-side piles 72, each comprising two superposed packets 58).

Each complete group 79 is conventionally pushed, in a manner not shown, along the supporting surface 78 in the direction of arrow 89 (FIG. 2) toward the parcelling or cartoning machine (not shown).

In FIG. 1 are also shown two stations 80 and 81, the station 81 underlaying a storage unit 82 containing a stack of nondefective packets.

As described in the U.S. Pat. No. 3,318,066, in the name of the same Applicant as herein, suitable means (not shown) rejects piles 72 containing one or more defective packets from the station 80, and in the station 81 a new pile is supplied from the storage unit 82.

What we claim is:

1. An apparatus for forming groups of side-by-side piles of parallelpipedal-shaped articles, in particular cigarette packets, the groups being supplied to a parcelling or cartoning machine, the apparatus including a rejecting and replenishing device for rejecting defective piles and replenishing said defective piles with non-defective piles, said apparatus comprising:

a vertically and reciprocatingly movable pile-forming means positioned upstream of said rejecting and replenishing device, for forming piles of a preselected number n of articles;

first and second means synchronously and reciprocatingly moving with a frequency equal to 1/n that of said pile-forming means, said first means for feeding individual piles into said ejecting and replenishing device, and said second means for sequentially removing piles from said rejecting and replenishing device, and for feeding successive piles along an exiting channel, from which individual complete groups of side-by-side piles are conventionally fed to said parcelling or cartoning machine;

an intermittently and unidirectionally rotating wrapping wheel provided with a plurality of radially disposed pockets, a first horizontal inlet channel along which individual articles are sequentially fed into each pocket of said wrapping wheel during each dwell thereof, a second outlet channel coplanar with said first inlet channel, and pushing means for sequentially removing individual articles from said radial pockets and for pushing said removed articles onto said second outlet channel further comprising:

a third channel extending above, parallel to and partially overlapping said second channel;

resiliently movable retaining means positioned along the opposite longitudinal sides of the overlapping area of said third channel relative to said second channel;

lifting means positioned underneath said second channel in alignment with said retaining means, and cyclically and reciprocatingly moved in a vertical direction by cam driving means for sequentially transferring articles from said second channel in a piled relationship above said retaining means;

a stepwise, unidirectionally rotating horizontal wheel provided with a plurality of radially disposed compartments coplanar with said third channel;

a fourth channel coplanar with said third channel and oppositely positioned relative to said horizontal compartmented wheel;

driving means for stepwise, unidirectionally rotating said horizontal compartmented wheel with a frequency submultiple relative to the cyclic frequency of said lifting means, and for dwelling a compartment and the relative oppositely disposed compartment in alignment, respectively, with said third channel and said fourth channel; and a first and a second pushing means horizontally and reciprocatingly moved along a path parallel to and above said third channel and said horizontal compartmented wheel in unison actuated by cam driving means with a frequency equal to the dwelling frequency of said horizontal compartmented wheel, said first pushing means transferring individual piles from said third channel into that one of the compartments of the horizontal compartmented wheel which is dwelling in alignment with the same third channel, and said second pushing means for removing individual piles from said oppositely disposed compartment, and for pushing said piles onto said fourth channel, along which successive piles are approached together in a side-by-side relationship to form groups of piles to be fed to said parcelling or cartoning machine.

2. The apparatus defined in claim 1 wherein the length of said second and third channels is equal to a multiple of the dimension of the articles as measured in the direction of their advancement, the difference in height between said second and third channels being at least equal to the dimension of the same articles as measured in a direction perpendicular to said advancement.

3. An apparatus for forming groups of cigarette packets to be supplied to a parcelling or cartoning machine, said apparatus comprising:

an intermittently and unidirectionally rotatable wrapping wheel provided with a plurality of radial pockets;

a first horizontal inlet channel along which individual packets are sequentially fed into each pocket of said wrapping wheel during a dwell thereof;

a second outlet channel coplanar with said first inlet channel;

pushing means for sequentially removing individual articles form said radial pocket and for pushing said removed articles onto said second outlet channel;

a third channel extending above, aprallel to and partially overlapping said second channel;

resiliently removable retaining means positioned along the opposite longitudinal sides of the overlapping areas of said third channel relative to said second channel;

lifting means positioned underneath said second channel in alignment with said retaining means and cyclically and reciprocatingly movable in a vertical direction by cam driving means for sequentially transferring articles from said second channel in a piled relationship above said retaining means;

a stepwise unidirectionally rotatable horizontal wheel provided with a plurality of radially disposed compartments coplanar with said third channel;

a fourth channel coplanar with said third channel and positioned opposite the same relative to said horizontal compartmented wheel; and driving means for the stepwise unidirectional rotation of said horizontal compartmented wheel with a frequency which is a submultiple of the cyclic frequency of said lifting means for causing dwell of a compartment and the oppositely disposed compartment in alignment respectively with said third and fourth channels.

4. The apparatus defined in claim 3 further comprising: a first and second pushing means horizontally and reciprocatingly moved along a path parallel to and above said third channel and said horizontal compartmented wheel in unison actuated by cam driving means with a frequency equal to the dwelling frequency of said horizontal compartmented wheel, said first pushing means transferring individual piles from said third channel, and said second pushing means for removing individual piles from said oppositely disposed compartment, and for pushing said piles onto said fourth channel, along which successive piles are approached together in a side-by-side relationship to form groups of piles to be fed to said parcelling or cartoning machine.

5. The apparatus defined in claim 4 wherein the length of said second and third channels is equal to a multiple of the dimension of the articles as measured in the direction of their advancement, the difference in height between said second and third channels being at least equal to the dimension of the same articles as measured in a direction perpendicular to said advancement.

* * * * *